US010599087B2

(12) United States Patent
Ishii

(10) Patent No.: US 10,599,087 B2
(45) Date of Patent: Mar. 24, 2020

(54) IMAGE FORMING APPARATUS AND RECORDING MEDIUM

(71) Applicant: Konica Minolta, Inc., Chiyoda-ku, Tokyo (JP)

(72) Inventor: Hiroshi Ishii, Hino (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 16/262,301

(22) Filed: Jan. 30, 2019

(65) Prior Publication Data

US 2019/0243295 A1 Aug. 8, 2019

(30) Foreign Application Priority Data

Feb. 2, 2018 (JP) ..... 2018-016858

(51) Int. Cl.
*G03G 15/00* (2006.01)

(52) U.S. Cl.
CPC ..... *G03G 15/55* (2013.01); *G03G 15/5062* (2013.01)

(58) Field of Classification Search
CPC ..... G03G 15/5062; G03G 15/55
See application file for complete search history.

(56) References Cited

U.S. PATENT DOCUMENTS 5,652,943 A * 7/1997 Matsuo ..... B65H 5/00 399/21
6,345,170 B1 * 2/2002 Nakazato ..... G03G 15/6564 399/21
2007/0071468 A1 * 3/2007 Yako ..... G03G 15/5029 399/45
2012/0189325 A1 * 7/2012 Kushima ..... G03G 15/5004 399/9
2019/0354054 A1 * 11/2019 Yamamoto ..... G03G 15/5062

FOREIGN PATENT DOCUMENTS

JP 2011253187 A 12/2011

* cited by examiner

*Primary Examiner* — Sevan A Aydin
(74) *Attorney, Agent, or Firm* — Buchanan Ingersoll & Rooney PC

(57) ABSTRACT

An image forming apparatus which includes a plurality of parts including a rotating unit and which uses the plurality of parts to form an image on a sheet is shown. The apparatus includes the following, a sheet conveyor, an image former, and an image reader. A hardware processor controls a conveying interval of the sheet by the sheet conveyor, controls the image former to form an image on the sheet and to output the sheet, detects a defect from the read image data, and diagnoses a failed part in which the defect is detected periodically based on information of the detected defect and a cycle of the part. When the failed part is diagnosed, the hardware processor controls the image former to form an image for failure diagnosis and sets a conveying interval of the sheet by the sheet conveyor larger than the conveying interval in normal image forming.

12 Claims, 14 Drawing Sheets

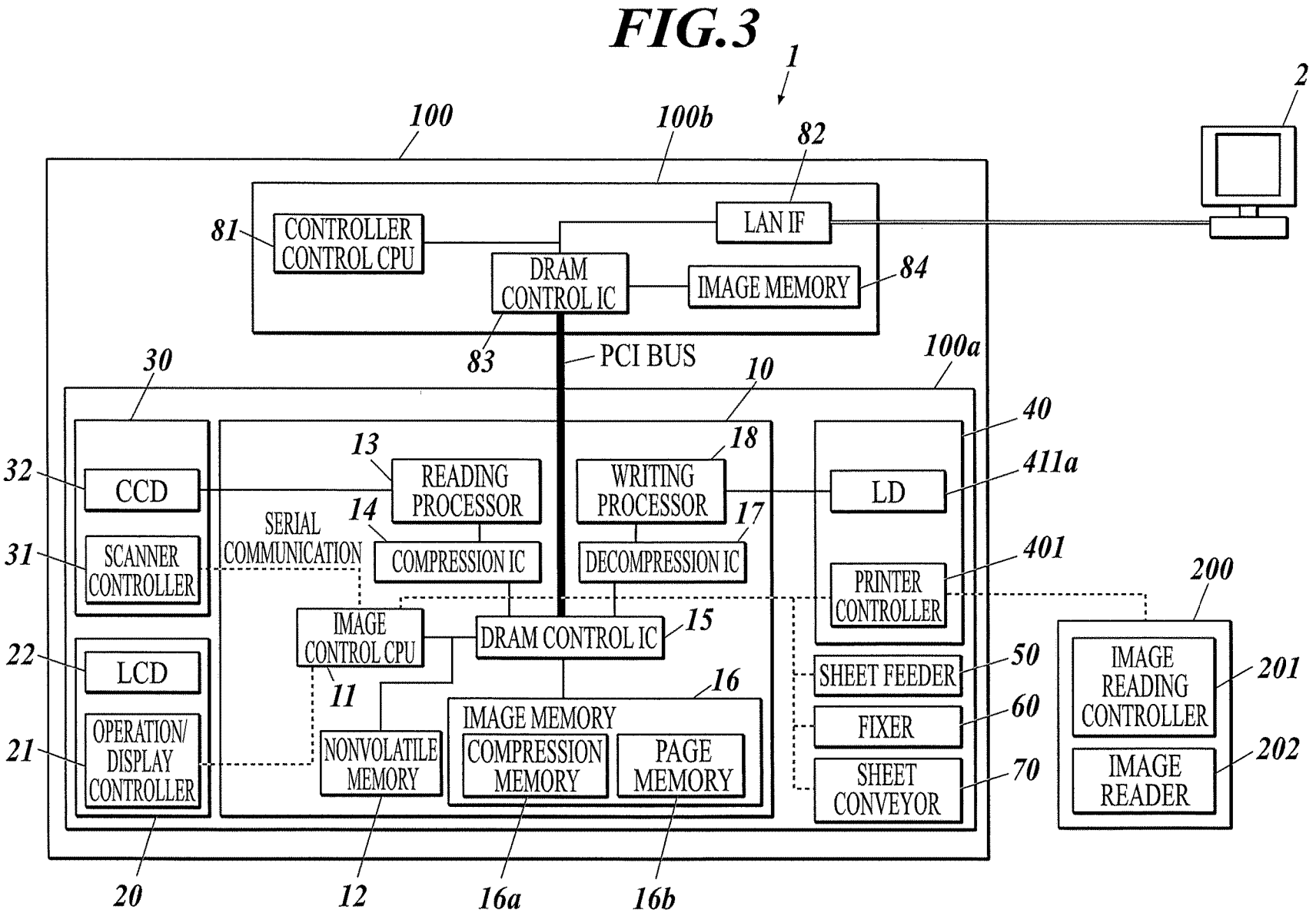
FIG.3
1
2
100
100a
100b
10
11
12
13
14
15
16
16a
16b
17
18
20
21
22
30
31
32
40
50
60
70
81
82
83
84
200
201
202
401
411a
LAN IF
IMAGE MEMORY
CONTROLLER CONTROL CPU
DRAM CONTROL IC
PCI BUS
WRITING PROCESSOR
DECOMPRESSION IC
READING PROCESSOR
COMPRESSION IC
DRAM CONTROL IC
IMAGE MEMORY
COMPRESSION MEMORY
PAGE MEMORY
IMAGE CONTROL CPU
NONVOLATILE MEMORY
SERIAL COMMUNICATION
LD
PRINTER CONTROLLER
SHEET FEEDER
FIXER
SHEET CONVEYOR
CCD
SCANNER CONTROLLER
LCD
OPERATION/ DISPLAY CONTROLLER
IMAGE READING CONTROLLER
IMAGE READER

T1

T11 T12

| PART | CYCLE |
|---|---|
| INTERMEDIATE TRANSFER BELT | 2000 mm |
| PHOTORECEPTOR DRUM | 314 mm |
| DEVELOPER | 100 mm |

L1

| L10 NUMBER | L11 MAIN SCANNING POSITION | L12 SUB-SCANNING POSITION | L13 PHASE | L14 STATUS | L15 RESULT |
|---|---|---|---|---|---|
| ⋮ | ⋮ | ⋮ | ⋮ | ⋮ | ⋮ |

IMAGE FORMING APPARATUS AND RECORDING MEDIUM

BACKGROUND

Technological Field

The present invention relates to an image forming apparatus and a recoding medium.

Description of the Related Art

Conventionally, there is an image forming apparatus such as an electro-photographic type multifunctional printer which forms an image on a sheet using toner. The image forming apparatus includes a plurality of parts, and the part which is the reason for a stain (hit point scratch, fixed foreign matter, streak, waste, etc.) on the sheet on which the image is formed is diagnosed as a diagnosis for failure. When it is determined that there is a failure in the part, maintenance is performed on the part.

As a failure diagnosis function, there is an image forming apparatus which forms an image of a half-tone test pattern on a plurality of sheets, conveys the sheets, detects faults in the image on the sheet with a line sensor, determines whether the interval of the plurality of detected faults in the sub-scanning direction matches with a circumferential length of a part among the plurality of rotating parts, and determines that the matching part is the cause of the fault (Japanese Patent Application Laid-Open Publication No. 2011-253187).

However, the image forming apparatus as described in Japanese Patent Application Laid-Open Publication No. 2011-253187 employs a dedicated examination mode which diagnoses failures by forming an image of a test pattern dedicated to diagnosing the failure. Such technique is not an examination mode which diagnoses failure while forming images of the contents. Therefore, according to the image forming apparatus as described in Japanese Patent Application Laid-Open Publication No. 2011-253187, the number of sheets used for diagnosis of the failure is not considered, and paper is wasted to output large amounts of paper for failure diagnosis.

Specifically, when the image forming apparatus is a product printing machine (PP), the failure diagnosis needs to be performed frequently since the percentage of failure increases if the period that the apparatus is used becomes long. Therefore, according to the image forming apparatus as described in Japanese Patent Application Laid-Open Publication No. 2011-253187, a larger amount of paper may be wasted.

SUMMARY

The object of the present invention is to reduce the amount of sheets used in failure diagnosis.

To achieve at least one of the abovementioned objects, according to an aspect of the present invention, an image forming apparatus reflecting one aspect of the present invention is described, an image forming apparatus including a plurality of parts including a rotating unit and which uses the plurality of parts to form an image on a sheet, the apparatus including: a sheet conveyor which conveys a plurality of sheets; an image former which forms an image on the conveyed sheet; an image reader which reads image data on a sheet on which the image is formed; and a hardware processor which controls a conveying interval of the sheet by the sheet conveyor, which controls the image former to form an image on the sheet and to output the sheet, which detects a defect from the read image data, and which diagnoses a failed part in which the defect is detected periodically based on information of the detected defect and a cycle of the part, wherein when the failed part is diagnosed, the hardware processor controls the image former to form an image for failure diagnosis and sets a conveying interval of the sheet by the sheet conveyor larger than the conveying interval in normal image forming.

According to a second aspect of the present invention, a recording medium reflecting another aspect of the present invention is described, a non-transitory computer-readable recording medium having a program stored thereon for controlling a computer used in an image forming apparatus which includes a plurality of parts including a rotating unit and which uses the plurality of parts to form an image on a sheet, wherein the program controls the computer to function as: a sheet conveyor which conveys a plurality of sheets; an image former which forms an image on the conveyed sheet; an image reader which reads image data on a sheet on which the image is formed; and a hardware processor which controls a conveying interval of the sheet by the sheet conveyor, which controls the image former to form an image on the sheet and to output the sheet, which detects a defect from the read image data, and which diagnoses a failed part in which the defect is detected periodically based on information of the detected defect and a cycle of the part, wherein when the failed part is diagnosed, the hardware processor controls the image former to form an image for failure diagnosis and sets a conveying interval of the sheet by the sheet conveyor larger than the conveying interval in normal image forming.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 3 is a block diagram showing a functional configuration of the image forming apparatus.

DETAILED DESCRIPTION OF EMBODIMENTS

Hereinafter, one or more embodiments of the present invention will be described with reference to the drawings. However, the scope of the invention is not limited to the disclosed embodiments.

The embodiments of the present invention are described in detail with reference to the drawings.

Figure 1:
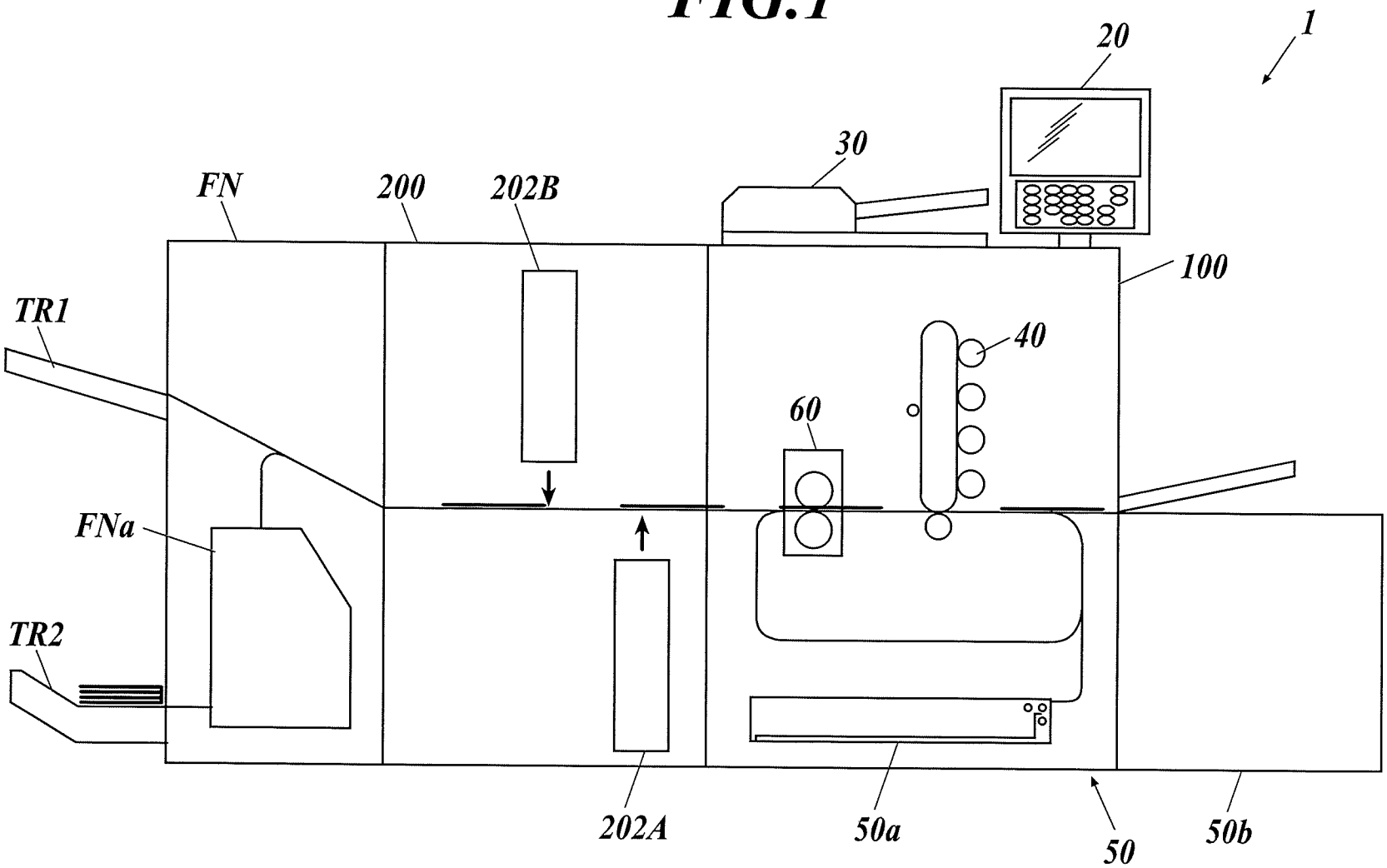
FIG. 1 is a schematic diagram showing a schematic configuration of an image forming apparatus according to an embodiment of the present invention.

First, the configuration of the apparatus according to the present embodiment is described with reference to FIG. 1 to FIG. 3. FIG. 1 is a diagram showing a schematic configuration of the image forming apparatus 1 according to a present embodiment.

As shown in FIG. 1, the image forming apparatus 1 forms an image on a sheet by an electro-photographic method. The image forming apparatus 1 is a color image forming apparatus employing a tandem method which overlaps toners in four colors, yellow (Y), magenta (M), cyan (C), and black (K).

As shown in FIG. 1, the image forming apparatus 1 includes an image forming apparatus main body 100, an image reading apparatus 200, and a finisher FN connected in series with the image reading apparatus 200 as an image reader.

The image forming apparatus main body 100 is the main body which forms an image on a sheet. The image forming apparatus main body 100 includes an operation/display unit 20, a scanning unit 30, an image former 40 as the image forming unit, a fixer 60, and a sheet feeder 50 as the sheet conveying unit. The internal configuration of the image forming apparatus main body 100 is described later.

The image reading apparatus 200 is an apparatus which reads the sheet output from the image forming apparatus main body 100 with the image formed, and feeds the result back to the image forming apparatus main body 100. The image reading apparatus 200 includes image readers 202A and 202B. The image reader 202A is provided on a conveying path of the sheet downstream of the image forming apparatus main body 100. The image reader 202A reads the image of one surface (for example, rear surface) of the sheet and obtains image data. The image reader 202B is provided on a conveying path of the sheet downstream of the image reader 202A. The image reader 202B reads the image of the other surface (for example, front surface) of the sheet and obtains image data. For example, the image readers 202A and 202B are color sensors which receive light emitted from a light source and reflected on the surface of the sheet and output a signal according to a strength of the light. The image readers 202A and 202B can be configured by a line sensor in which a plurality of light receiving elements are positioned at a predetermined interval in a direction orthogonal to a sheet conveying direction, or can be configured to read only a predetermined region in a direction orthogonal to the sheet conveying direction.

The finisher FN is an apparatus which performs a saddle stitching process when necessary on sheet output from the image reading apparatus 200, and includes a saddle stitching unit FNa. Specifically, when the saddle stitching process is not set in the print job, the finisher FN does not perform the saddle stitching process on the conveyed sheet and ejects the sheet as is to a sheet ejecting tray TR1. When the saddle stitching process is set in the print job, the saddle stitching unit FNa performs the saddle stitching process on the conveyed sheet and the finisher FN ejects the bound sheets (book) to a sheet ejecting tray TR2.

The finisher FN does not have to be provided in the image forming apparatus 1, and a finishing apparatus which is able to perform finishing processes other than the saddle stitching process such as a case binding process, a multi-hole punching process, or a creasing process which adds a crease to the sheet can be provided in the image forming apparatus 1.

The configuration of the image forming apparatus main body 100 is described with reference to FIG. 2. FIG. 2 is a diagram showing an internal configuration of the image forming apparatus main body 100.

Figure 2:
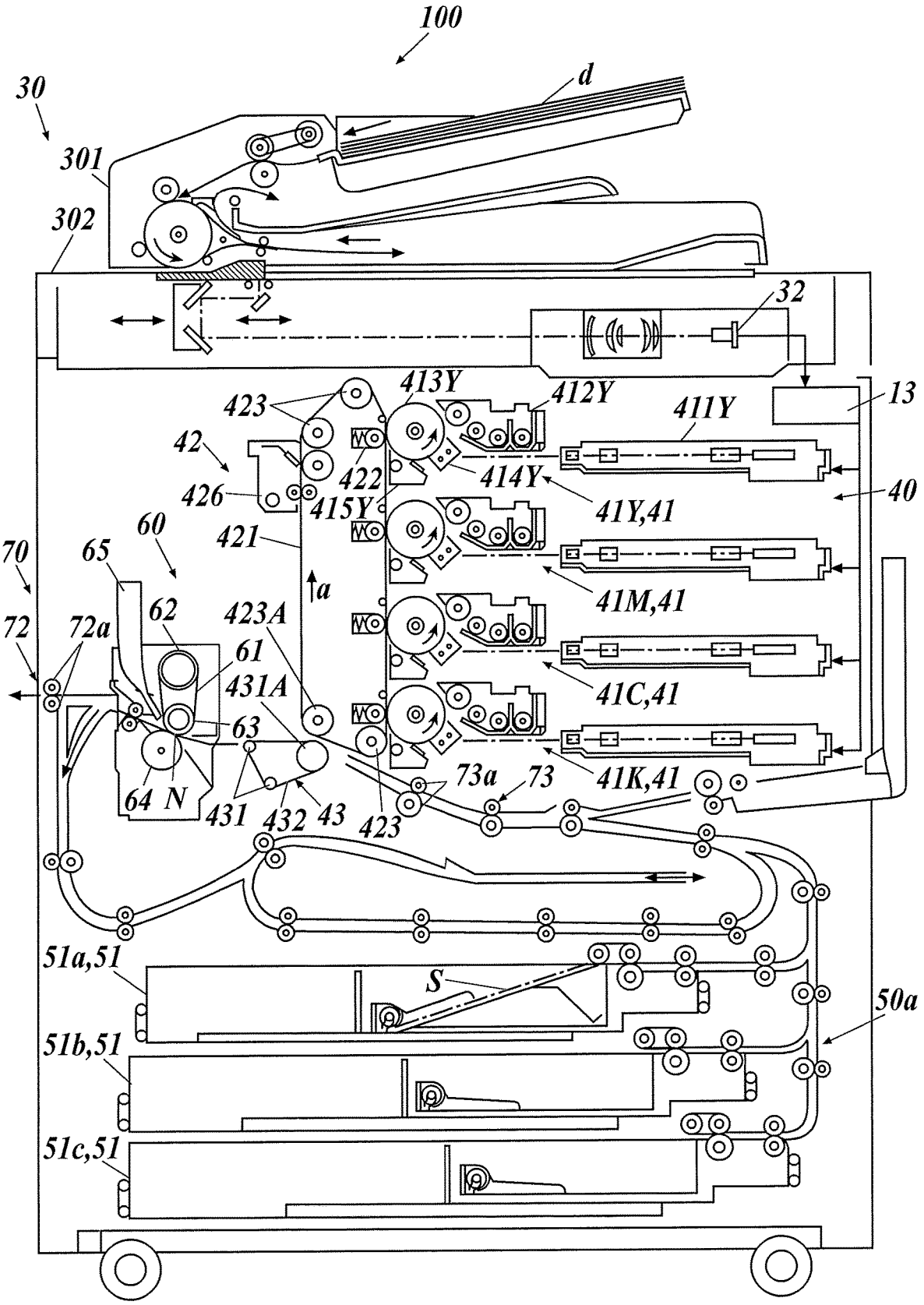
FIG. 2 is a diagram showing an internal configuration of a main body of the image forming apparatus.

As shown in FIG. 2, the image former 40 includes image forming units 41Y, 41M, 41C, and 41K which form an image using toner in various colors such as YMCK according to control by a later described image control CPU (Central Processing Unit) 11. The above image forming units 41Y, 41M, 41C, and 41K have the same configuration other than the stored toner, and thus the sign showing the color may be omitted in the description below. The image former 40 includes an intermediate transfer unit 42 and a secondary transfer unit 43.

The image forming unit 41 includes an exposer 411, a developer 412, a photoreceptor drum 413, a charger 414, and a drum cleaner 415. The photoreceptor drum 413 may be, for example, a negative charge type organic photoreceptor. The surface of the photoreceptor drum 413 is photoconductive. The charger 414 may be, for example, a corona charger. The charger 414 can be a contact charging apparatus which charges by contacting a contact charged member such as a charged roller, a charged brush, or a charged blade with the photoreceptor drum 413. The exposer 411 includes, for example, a LD (Laser Diode) 411*a* which outputs a laser beam as a light source and an optical deflecting apparatus (polygon motor) which emits a laser beam to the photoreceptor drum 413 according to the image to be formed.

The developer 412 is a developing apparatus in a two component developing format. For example, the developer 412 includes a developing container including a two-component developing material, a developing roller (magnetism roller) provided to be rotatable in an opening of the developing container, a partition which divides the inside of the developing container in a way that the two-component developing material is communicable, a conveying roller which conveys the two-component developing material in an opening side of the developing container to the developing roller, and a stirring roller which stirs the two-component developing material in the developing container. The developing container stores the toner as the two-component developing material.

The intermediate transfer unit 42 includes a primary transfer roller 422 which pressure contacts the intermediate transfer belt 421 to the photoreceptor drum 413, a plurality of supporting rollers 423 which include a secondary transfer roller Up (backup roller) 423A, and a belt cleaner 426. The intermediate transfer belt 421 is stretched in a loop around the plurality of supporting rollers 423. At least one of the driving rollers of the plurality of supporting rollers 423 rotates so that the intermediate transfer belt 421 runs at a certain speed in an arrow "a" direction.

The secondary transfer unit 43 includes a plurality of supporting rollers 431 including an endless secondary transfer belt 432 and a secondary transfer roller Lw (lower side)

431A. The secondary transfer belt 432 is stretched in a loop around the secondary transfer roller Lw 431A and the supporting roller 431.

According to the control by the later described image control CPU 11, the fixer 60 heats and pressures the sheet on which the image former 40 formed the toner image. The fixer 60 includes an endless fixing belt 61 which is a heating member, a heating roller 62, a fixing roller 63 which is positioned facing a pressuring roller 64, the pressuring roller 64, and an air separator 65. The fixing belt 61 is stretched around the heating roller 62 and the fixing roller 63. The heating roller 62 is internally provided with a heating unit such as a halogen heater (not shown) which heats the fixing belt 61. The fixing roller 63 forms a nip N between the fixing belt 61 and the pressuring roller 64.

As described above, when the pressuring roller 64 is rotated in the counter clockwise direction by the driver (not shown), the fixing belt 61, the heating roller 62, and the fixing roller 63 rotate in the clockwise direction. The fixing belt 61 in contact with the heating roller 62 is heated and the fixing roller 63 is also heated. Then, the sheet on which the toner image is formed passes the nip N and is heated and pressured so that the toner image transferred on the sheet is melted and fixed.

The air separator 65 sends air to the sheet ejected from the nip N to separate the sheet from the fixing belt 61. The air separator 65 includes a suction fan (not shown) which sucks air from outside and sends the air in the direction of the nip N, and a duct which is the path of the sent air. By separating the sheet from the fixing belt 61 using the air separator 65, the sheet can be separated without contacting a member such as a separating piece to the surface of the fixing belt 61. Therefore, the surface of the fixing belt 61 is not damaged.

The image forming apparatus main body 100 includes the scanning unit 30, a reading processor 13, the sheet feeder 50, and the sheet conveyor 70 as the sheet conveying unit. The scanning unit 30 includes a sheet feeding apparatus 301 and a scanner 302. According to control by the later-described image control CPU 11, the scanning unit 30 feeds a document d with the sheet feeding apparatus 301, scans the document d with the CCD (Charge Coupled Device) sensor 32 of the scanner 302, and obtains input image data. The sheet feeder 50 includes sheet feeders 50*a*, 50*b*. According to the control by the later-described image control CPU 11, the sheet feeder 50 feeds the sheet S to the image former 40. The sheets S (standard sheet, special sheet) discriminated based on basis weight and size are stored in advance according to the set type in the three sheet feeding tray units 51*a*, 51*b*, and 51*c* which compose the sheet feeder 50*a* and the external sheet feeder 50*b*.

The sheet conveyor 70 includes a sheet ejector 72 and a conveying path 73. According to control by the later-described image control CPU 11, the sheet conveyor 70 conveys the sheet S to the image former 40 using the sheet conveying path 73 and ejects the sheet S from the fixer 60 using the sheet ejector 72. The conveying path 73 includes a plurality of pairs of conveying rollers such as a registration roller pair 73*a*. The sheet conveyor 70 includes an inverting path which inverts the sheet on which an image is formed on one surface and which conveys the sheet to the image former 40 again.

Here, an example of an image forming method by the image forming apparatus main body 100 is described. The scanner 302 optically scans and reads the document d fed on the contact glass by the sheet feeding apparatus 301 or placed on the platen glass. The light reflected from the document d is read by the CCD sensor 32 of the scanner 302 and this is to be the input image data. Predetermined image processing is performed on the input image data in the reading processor 13 and sent to the exposer 411.

The photoreceptor drum 413 rotates at a certain circumferential speed. The charger 414 charges the entire surface of the photoreceptor drum 413 to a negative polarity. The exposer 411 rotates the polygon mirror of the polygon motor at a high speed, and the laser beam corresponding to the input image data of each color component is developed along the axis direction of the photoreceptor drum 413 to be irradiated on the outer circumferential surface of the photoreceptor drum 413 along the axis direction. With this, the electrostatic latent image is formed on the surface of the photoreceptor drum 413.

In the developer 412, toner particles are charged by stirring and conveying of the two-component developing material in the developing container, the two-component developing material is conveyed to the developing roller, and the magnetism brush is formed on the surface of the developing roller. The charged toner particles are attached electrostatically to the portion of the electrostatic latent image in the photoreceptor drum 413 from the magnetism brush. With this, the electrostatic latent image on the surface of the photoreceptor drum 413 becomes visible, and the toner image according to the electrostatic latent image is formed on the surface of the photoreceptor drum 413.

The toner image on the surface of the photoreceptor drum 413 is transferred on the intermediate transfer belt 421 using the intermediate transfer unit 42. The transfer remaining toner remaining on the surface of the photoreceptor drum 413 after transfer is removed by the drum cleaner 415 including the drum cleaning blade which slides against the surface of the photoreceptor drum 413.

The primary transfer roller 422 is used so that the intermediate transfer belt 421 pressure contacts the photoreceptor drum 413, and the photoreceptor drum 413 and the intermediate transfer belt 421 form the primary transfer nip for each photoreceptor drum. The primary transfer nip transfers toner images of each color sequentially overlapped on the intermediate transfer belt 421.

The secondary transfer roller Lw 431A is pressure contacted with the secondary transfer roller Up 423A through the intermediate transfer belt 421 and the secondary transfer belt 432. With this, the secondary transfer nip is formed with the intermediate transfer belt 421 and the secondary transfer belt 432. The sheet S passes the secondary transfer nip. The sheet conveyor 70 conveys the sheet S to the secondary transfer nip. The registration roller unit in which the registration roller pair 73*a* are provided corrects the tilt of the sheet S and adjusts the timing of conveying the sheet S.

When the sheet S is conveyed to the secondary transfer nip, the transfer bias is applied to the secondary transfer roller Lw 431A. By applying the transfer bias, the toner image held by the intermediate transfer belt 421 is transferred to the sheet S. The sheet S in which the toner image is transferred is conveyed by the secondary transfer belt 432 to the fixer 60.

The fixer 60 forms a nip N with the fixing belt 61 and the pressuring roller 64, and the conveyed sheet S is heated and pressured at the nip N. The toner particles composing the toner image on the sheet S are heated and crystalline resin inside melt quickly. As a result, the entire toner particle melts quickly with a relatively small amount of heat, and the toner components are attached to the sheet S. With this, the toner image is fixed to the sheet S quickly with a relatively small amount of heat. The sheet S with the toner image fixed is ejected to the image reading apparatus 200 by the sheet ejector 72 including the sheet ejecting roller 72*a* of the sheet conveyor 70. With this, an image with high quality is formed.

The residual toner remaining on the surface of the intermediate transfer belt 421 after the secondary transfer is removed by the belt cleaner 426 including the belt cleaning blade which slides against the surface of the intermediate transfer belt 421.

Next, the functional configuration of the image forming apparatus 1 is described with reference to FIG. 3. FIG. 3 is a block diagram showing a functional configuration of the image forming apparatus 1.

The image forming apparatus main body 100 forms a color image with the electro-photographic method based on image data obtained by reading the image from a document or image data received from an external apparatus 2. The image forming apparatus main body 100 includes a main body unit 100*a* and a print controller 100*b*. The image forming apparatus main body 100 is connected to the external apparatus 2 on the network through the LAN IF (Local Area Network Interface) 52 of the print controller 100*b* so as to be able to transmit and receive information between each other.

The main body unit 100*a* includes the main body controller 10, the operation/display unit 20, the scanner unit 30, and the image former 40.

The main body controller 10 includes an image control CPU 11 as a sheet output controller, a defect detecting unit, and a diagnostic unit, a nonvolatile memory 12, a reading processor 13, a compression IC (Integrated Circuit) 14, a DRAM (Dynamic Random Access Memory) control IC 15, an image memory 16, a decompression IC 17 and a writing processor 18.

Based on the operation signal output from the operation/display unit 20, the image control CPU 11 reads various programs stored in the nonvolatile memory 12 and deploys the above in the RAM (not shown), and executes the various processes in coordination with the deployed programs to control each unit of the image forming apparatus 1. The nonvolatile memory 12 includes a nonvolatile semiconductor memory in which data can be read and written, and various programs and various data regarding the image forming apparatus 1 are stored. Specifically, the nonvolatile memory 12 stores the following, later described cycle table T1 and failure diagnostic program.

The reading processor 13 performs an analog process, a shading process, an A/D (Analog to Digital) conversion process and the like on the analog image signal output from the scanner unit 30 (CCD sensor 32), and the digital image data is generated. The reading processor 13 outputs the generated image data to a compression IC 14. After the compression process is performed on the image data output from the reading processor 13, the compression IC 14 outputs the image data to a DRAM control IC 15.

Based on the control by the image control CPU 11, the DRAM control IC 15 controls a compression process of image data by the compression IC 14 and a decompression process of the compressed image data by the decompression IC 17 and controls input/output of image data between the image memory 16. For example, when the storage of the image data read by the scanner unit 30 is instructed, the DRAM control IC 15 controls the compression IC 14 to perform the compression process of the image data output from the reading processor 13 and to store the compressed image data in the compression memory 16*a* of the image memory 16. When the print output of the compressed image data stored in the compression memory 16*a* is instructed, the DRAM control IC 15 reads out the compressed image data from the compression memory 16*a*, and controls the decompression IC 17 to perform the decompression process and to store the data in the page memory 16*b*. The DRAM control IC 15 reads out the non-compressed image data from the page memory 16*b* and outputs the data to the writing processor 18.

The image memory 16 is composed of a DRAM and is provided with a compression memory 16*a* and a page memory 16*b*. The compression memory 16*a* stores the compressed image data. The page memory 16*b* temporarily stores non-compressed image data as the target of printing before forming the image.

The decompression IC 17 outputs the image data to the DRAM control IC 15 after performing the decompression process on the compressed image data read from the compression memory 16*a*. Based on the image data as the target of printing output from the DRAM control IC 15, the writing process 18 generates the print image data to form the image and outputs the data to the image former 40.

The operation/display unit 20 is provided with an operation/display controller 21, and a LCD (Liquid Crystal Display) 22. The operation/display controller 21 performs control of the display on the LCD 22 based on the instruction from the image control CPU 11 and also outputs to the image control CPU 11 the operation signal generated by the user pressing the operation keys or the touch panel (not shown). The LCD 22 is provided with a touch panel provided to cover the LCD 22 and displays on the screen the various setting screens according to the instruction of the display signal output from the operation/display controller 21, state of the image, and state of operation of each function.

The scanner unit 30 includes a scanner controller 31 which drives and controls the CCD sensor 32 and the CCD sensor 32. The scanner unit 30 exposes and scans with a light source the document surface of the document d fed on the contact glass by the sheet feeding apparatus 301 or placed on the platen glass. The scanner unit 30 receives the reflected light from the document surface, photo-electrically converts the received reflected light with the CCD sensor 32, and generates the analog image signal. The scanner unit 30 outputs the generated analog image signal to the reading processor 13.

The image former 40 includes a printer controller 401 and various units such as the exposer 411 including the LD 411*a*. The printer controller 401 controls operations of each unit in the image former 40 based on the instruction by the image control CPU 11. For example, the printer controller 401 forms the image on the sheet based on the print image data output from the writing processor 18.

The sheet feeder 50, the fixer 60, and the sheet conveyor 70 are connected to the image control CPU 11. According to control by the image control CPU 11, the sheet feeder 50, the fixer 60, and the sheet conveyor 70 feeds the sheet S, heats and pressures the sheet S on which the image is formed, and conveys the sheet S. Specifically, the image control CPU 11 controls the sheet feeder 50 and the sheet conveyor 70 (image former 40, fixer 60) so as to be able to expand the interval of conveying the sheet (sheet interval) in failure diagnosis as described later compared to normal image forming. Normal image forming means when the failure diagnosis is not performed and the contents image is formed.

When the image forming apparatus 1 is used as a network printer, the print controller 100*b* manages and controls the print job output from the external apparatus 2 connected to the network to the image forming apparatus 1. The print controller 100*b* receives the data as the print target from the external apparatus 2, and transmits the data as the print job data to the main body unit 100*a*. The print controller 100*b* includes a controller control CPU 81, a LANIF 82, a DRAM control IC 83, and an image memory 84.

The controller control CPU 81 centrally controls the operation of each unit in the print controller 100*b* and outputs the image data output from the external apparatus 2 through the LANIF 82 as the print job to the main body unit 100*a*.

The LANIF 82 is a communication interface to connect with a LAN such as a NIC (Network Interface Card) or modem, and receives the image data as the print target through the network from the external apparatus 2. The LANIF 82 outputs the received image data to the DRAM control IC 83.

The DRAM control IC 83 controls storing the image data received through the LANIF 82 in the image memory 84 and readout of the image data from the image memory 84. The DRAM control IC 83 is connected with the DRAM control IC 15 of the main body controller 10 of the main body unit 100*a* by a PCI (Peripheral Components Interconnect) bus. According to an instruction from the controller control CPU 81, the image data as the print target is read out from the image memory 84 and the data is output to the DRAM control IC 15.

The image memory 84 is composed of a DRAM and temporarily stores the input image data.

The external apparatus 2 generates the data of the print job printed by user operation and transmits the above to the image forming apparatus 1 through the network. As the external apparatus 2, for example, a PC (Personal Computer) or server apparatus, or a portable device such as a tablet PC can be applied.

The image reading apparatus 200 is provided with an image reading controller 201 and an image reader 202. The image reading controller 201 centrally controls operation of each unit of the image reading apparatus 200, and the image data read by the image reader 202 is output to the image control CPU 11 through the printer controller 401. The image reader 202 includes image readers 202A, 202B. The image reader 202 reads the image on the sheet S on which an image is formed by the image former 40 and the image is fixed by the fixer 60, and the read image data is output to the image reading controller 201.

Although illustration is omitted in FIG. 3, the finisher FN is connected to the image control CPU 11 through the image reading controller 201. According to control by the image control CPU 11, the finisher FN performs the finishing process such as saddle stitching on the sheets S input from the image reading apparatus 200 and ejects the sheet.

Figures 4A, 4B:
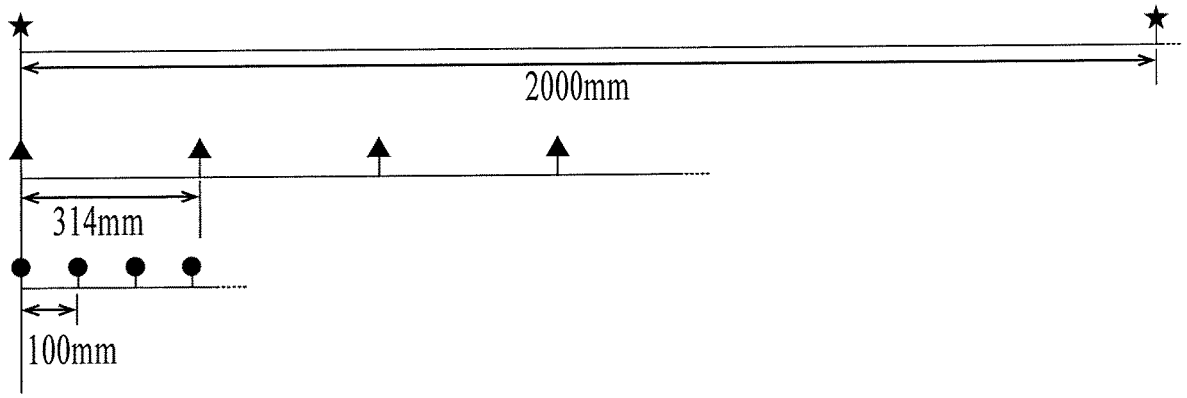
FIG. 4A is a diagram showing a cycle table.
FIG. 4B is a diagram showing a cycle for each part as described in the cycle table.

Next, the information stored in the nonvolatile memory 12 is described with reference to FIG. 4A, FIG. 4B. FIG. 4A is a diagram showing a cycle table T1. FIG. 4B is a diagram showing the cycle of each part shown in the cycle table T1.

As shown in FIG. 4A, the cycle table T1 stored in the nonvolatile memory 12 includes the following items, part T11, and cycle T12. The part T11 shows the name of rotating parts (hereinafter simply referred to as parts) among the parts of the image forming apparatus 1 which include a rotating unit and which may form a periodic defect on the sheet S when the part fails. For example, the part T11 may include the intermediate transfer belt 421, the photoreceptor drum 413, and the developer 412 (developing roller). In the part T11, the photoreceptor drum 413 and the developer 412 are collectively set for four colors (YMCK) but the above can be set separately for each color. The following parts may be set as the part T11, the primary transfer roller 422, the secondary transfer roller Up 423A, the supporting roller 423, the secondary transfer roller Lw 431A, the secondary transfer belt 432, the fixing belt 61, the fixing roller 63, and the pressuring roller 64.

The cycle T12 is the cycle of the rotating portion corresponding to the part shown in the part T11. The cycles of the intermediate transfer belt 421, the photoreceptor drum 413, and the developer 412 shown in the part T11 is represented on the circumferential length repeated in the left and right direction of FIG. 4B. As shown in FIG. 4B, in the cycles of the intermediate transfer belt 421, the photoreceptor drum 413, and the developer 412, the positions where defects such as hitting point scratch and lubricant hardening occurs is shown with the following marks, star, triangle, and circle. Here, in order from those with long cycles, the marks showing the star, the triangle and the circle are applied.

The marks showing the star, the triangle, and the circle are used in FIG. 5 to FIG. 8 as failures due to parts with a long, medium and short cycle. In FIG. 5 to FIG. 8, the above do not correspond to the cycles of the intermediate transfer belt 421, the photoreceptor drum 413 and the developer 412 described in the part T11.

Figure 5:
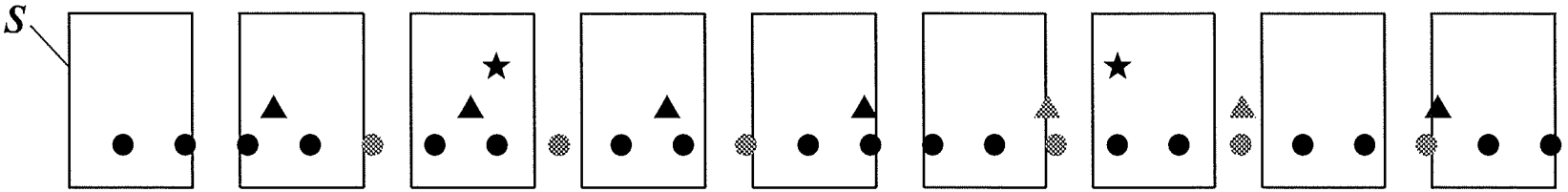
FIG. 5 is a diagram showing output of a sheet when there is a failure in a conventional image forming apparatus.
Figure 6:
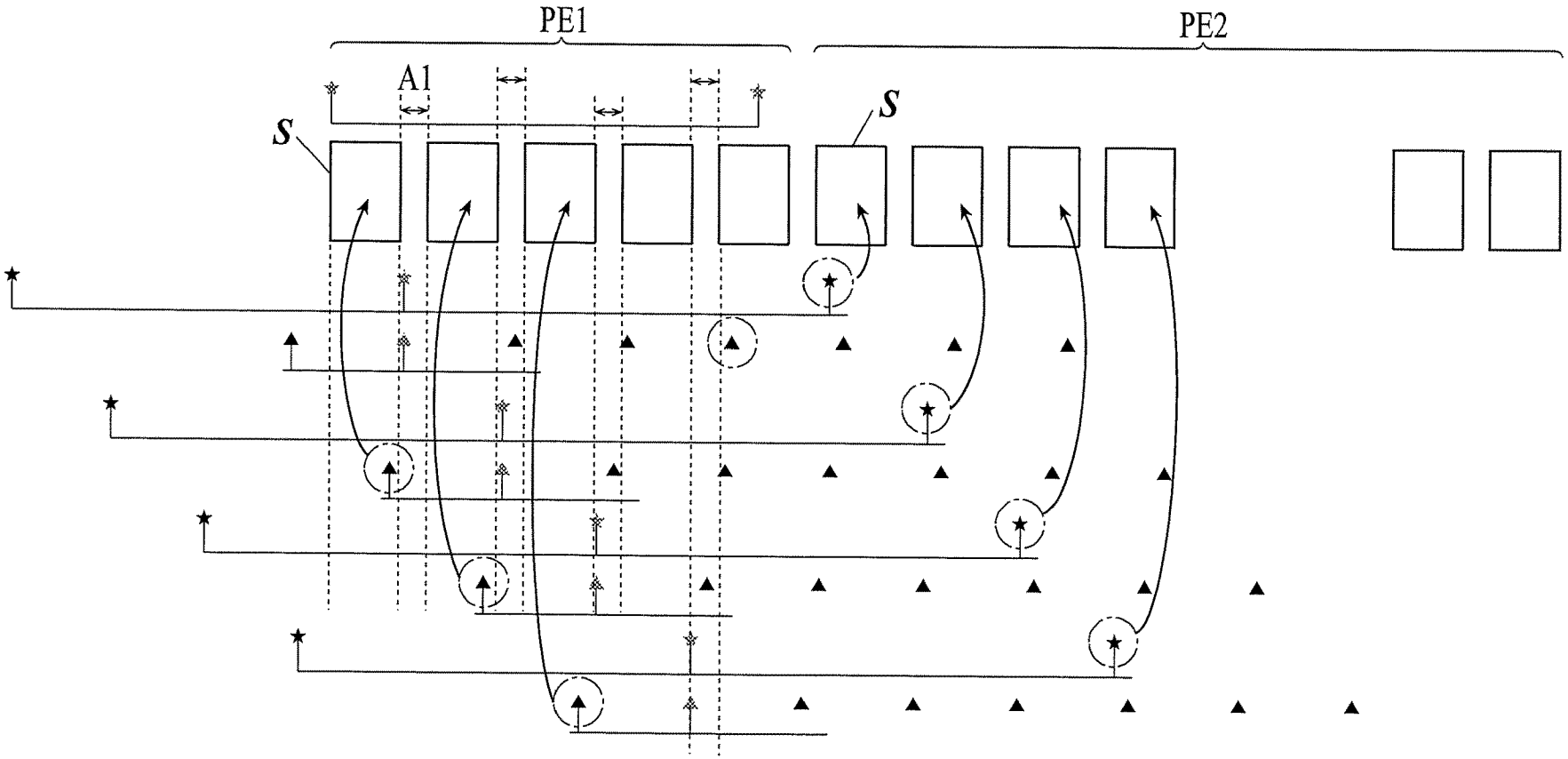
FIG. 6 is a diagram showing output of a sheet for cycle confirmation of the defect in the conventional image forming apparatus.
Figure 7:
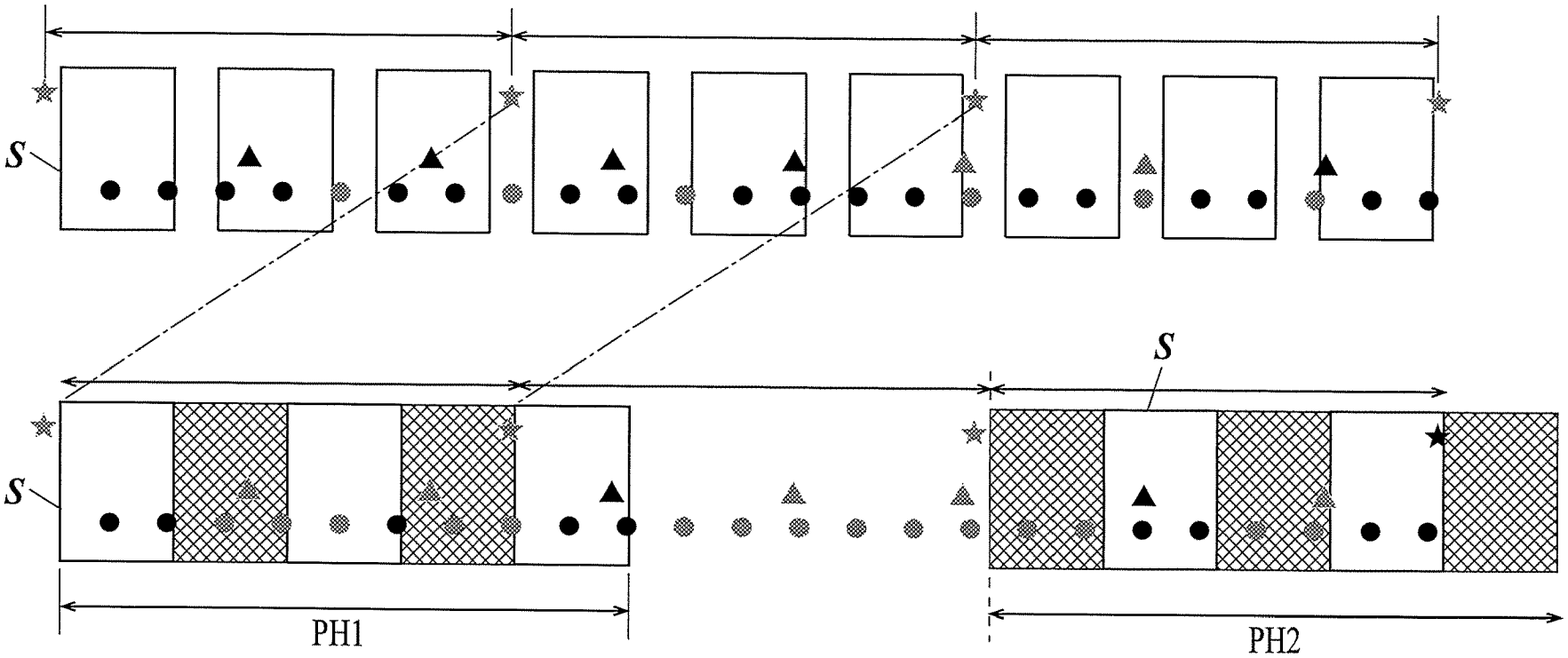
FIG. 7 is a diagram showing output of a sheet in first and second phases according to the image forming apparatus.
Figure 8:
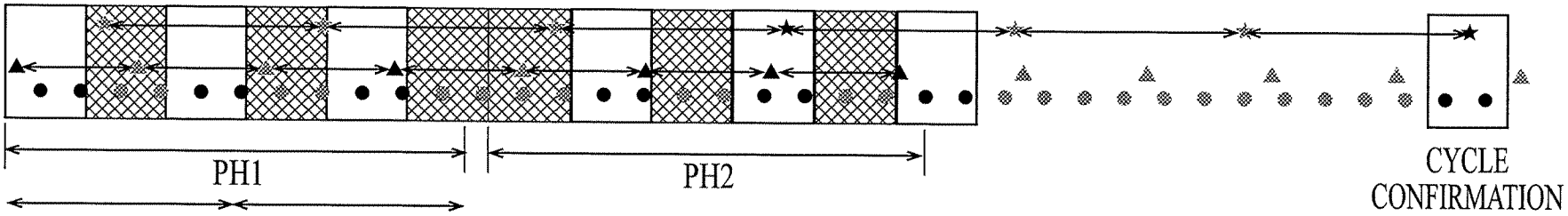
FIG. 8 is a diagram showing output of a sheet in cycle confirmation after output of the sheet in first and second phases according to the image forming apparatus.

Next, with reference to FIG. 5 to FIG. 14, the operation of the image forming apparatus 1 is described. First, with reference to FIG. 5 to FIG. 8, the summary of the operation to confirm the defect in the conventional image forming apparatus and the image forming apparatus 1 according to the present embodiment is described. FIG. 5 is a diagram showing output of the sheet when there is a defect in the conventional image forming apparatus. FIG. 6 is a diagram showing output of the sheet to confirm the cycle of the defect in the conventional image forming apparatus. FIG. 7 is a diagram showing the output of the sheet in phases PH1 and PH2 in the image forming apparatus 1. FIG. 8 is a diagram showing the output of the sheet to confirm the cycle after the output of the sheet in phases PH1 and PH2 in the image forming apparatus 1.

Here, the conventional image forming apparatus including the image reading apparatus is considered. When the image is formed on the sheet in the conventional image forming apparatus, the interval between the plurality of conveyed sheets (conveying interval of the plurality of sheets S) is a fixed value. Below, forming the image on the sheet, conveying the sheet and ejecting the sheet may be described as "output of the sheet". Therefore, if the interval between the sheets is shortened, the number of sheets that are output for a unit of time (printing speed) increases and this is preferable. The sheet interval is set considering the limit of the time necessary for the image former 40 and the fixer 60. For example, considering the maximum printing speed of an A4 sheet, the sheet interval is set at a fixed value smaller than the width of one sheet in the sub-scanning direction (sub-scanning width).

When the periodic defect occurs in the image forming and the failure diagnosis to diagnose the failed part is performed, it is necessary to specify at least two positions of the defect in the same main scanning position. FIG. 5 shows an example of the conventional image forming apparatus, and the sheets S output including the sheet interval are aligned in the direction from left to right. There is a defect in the marks showing the star, the triangle, and the circle due to failure in the three types of parts in the conventional image forming apparatus. The defects on the output sheet S are read and detected by the image reading apparatus. In FIG. 5 to FIG. 8, the marks showing the star, the triangle, and the circle are shown with gray for those corresponding to the sheet interval as the non-sensing region and as a result, those which are not formed as the image on the sheet S. The marks are shown with black for those on which the image is formed on the sheet S. In FIG. 5, at least two points of the defects of all the marks showing the star, the triangle, and the circle are formed on the sheet S. With this, the two defect positions can be specified and the cycle can be determined.

As shown in FIG. 6, in the conventional image forming apparatus, when the position (phase) of the defect is out of position from the sheet S, further sheets S need to be output in order to output the sheet S with two defects. In FIG. 6, the cycles of the defects with the marks showing the star and the triangle (long, medium) are considered. In FIG. 6, a pattern with four marks showing the star and the triangle with phases shifted from each other is shown, and the position with the circle is the first position where the defect is formed on the sheet S.

For example, when output of the sheet is performed with the normal sheet interval used in output of the sheet S with the size A4, as shown in FIG. 6, the defect in the sheet interval is in a non-sensing region A1, and the defect cannot be detected. Therefore, the sheets S are output to be a term PE2 with the length of a few cycles assuming that the defect occurs in the non-sensing region after the sheets S are output in a term PE1 for one cycle of the part with the largest cycle (mark star). Alternatively, the test pattern is formed again in a separate position at a cycle where the defect is assumed to occur from the non-sensing region A1, and the sheet S is output and read. Therefore, the number of sheets that are output becomes large. Here, whether the defect in the cycle shorter than the maximum cycle can be detected within the output of the maximum cycle is calculated, and the sheet is output in the amount necessary to check the non-sensing region. Moreover, due to the position of the image reading apparatus, the distance from after the sheet is output to where the sheet can be read is far, and it is difficult to control the output after confirming the reading result. As a result, it may be necessary to output the same number of sheets as the sheet interval for the output of the maximum cycle. It may be difficult to detect the defect depending on the cycle of the defect.

Instead of the output of the sheets S to confirm the cycle of the defect in the conventional image forming apparatus as shown in the upper side of FIG. 7, as shown in the lower side of FIG. 7, according to the image forming apparatus 1 of the present embodiment, the sheet interval of the sheets S is controlled in advance to be enlarged than the normal interval when the image is formed, and the output of sheets S is performed in the phases PH1 and PH2 in a cycle different from the normal output.

The sheet S is output in the length equal to or longer than the maximum cycle of the defect with the sheet interval the same as the sub-scanning width of the sheet S. Therefore, the defect can be detected without gaps with the smallest number of sheets S. The phase PH1 outputs at least the maximum cycle of the part as the target of diagnosis. The phase PH2 starts the output of the sheet S at a position with the phase shifted 180 degrees from the phase of the top of cycle in the phase PH1. When there are a plurality of cycles (parts) to confirm, the sheet output is started from the position with the phase of the sheet S shifted 180 degrees as many times as the number of cycles (parts) to confirm. Here, 180 degrees of the phase of the sheet S corresponds to one sheet S (sub-scanning width of one sheet). As shown in FIG. 7, the phase PH2 is able to detect at least one point in the defect of the maximum cycle (mark star).

The output sheet S can be a sheet in any size included in the sheet feeder 50. When the main scanning width of the sheet S is short, the examination can be performed only within this width. There is no problem if the examined width is the same width as the sheet S output after the failure diagnosis. Therefore, the sheet interval is set to A3 when the failure diagnosis is performed with the sheet S with the size A3, and the sheet interval is set to A4 when the failure diagnosis is performed with the sheet S with the size A4. The defect may be difficult to check in the joint, and the sheet interval can be made about 10 mm shorter than the size of the sheet S.

When no defects are detected in the sheet output in phases PH1 and PH2, it is possible to determine that there is no failure (abnormality). When two or more defects are detected in the same main scanning position in the output of the sheets S in phases PH1 and PH2, the cycle is specified and the failed part is specified. As shown in FIG. 8, after the phase PH2 ends, when only one defect which is the mark showing the star is detected in the same main scanning position, the sheets S for confirming the cycle are output and the image is read. The output is performed in the assumed cycle (expected cycle) and therefore, the cycle can be confirmed by output of the minimum number of sheets S.

Figure 9:
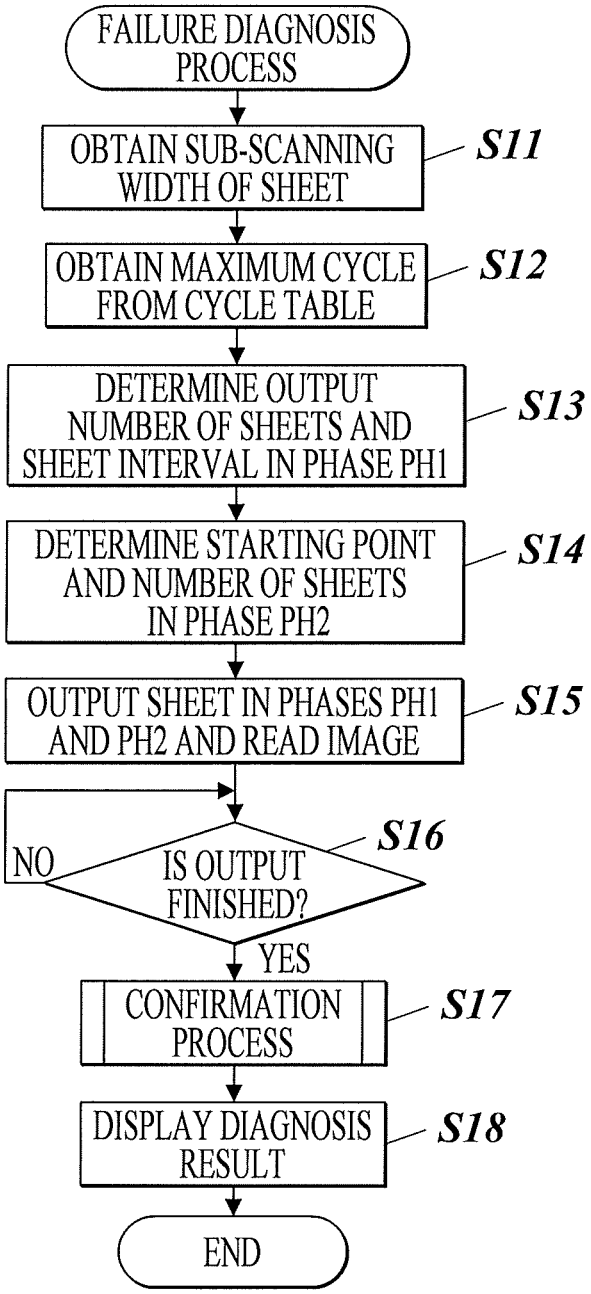
FIG. 9 is a flowchart showing a failure diagnosis process.
Figure 10:
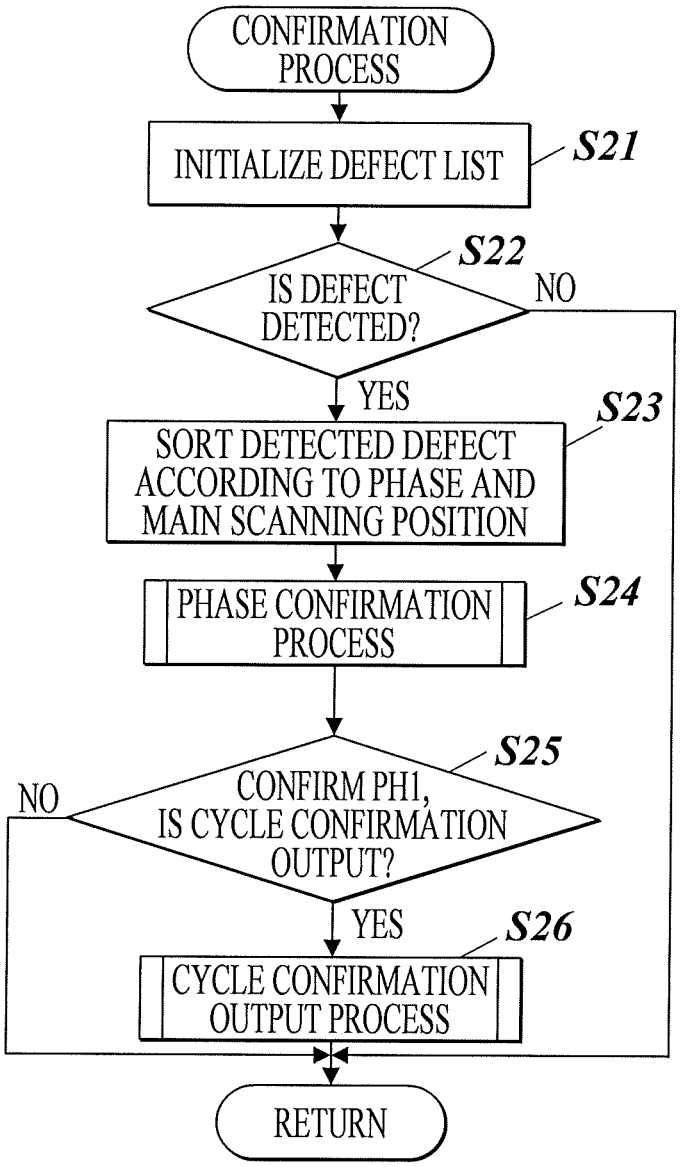
FIG. 10 is a flowchart showing a confirmation process.
Figure 11:
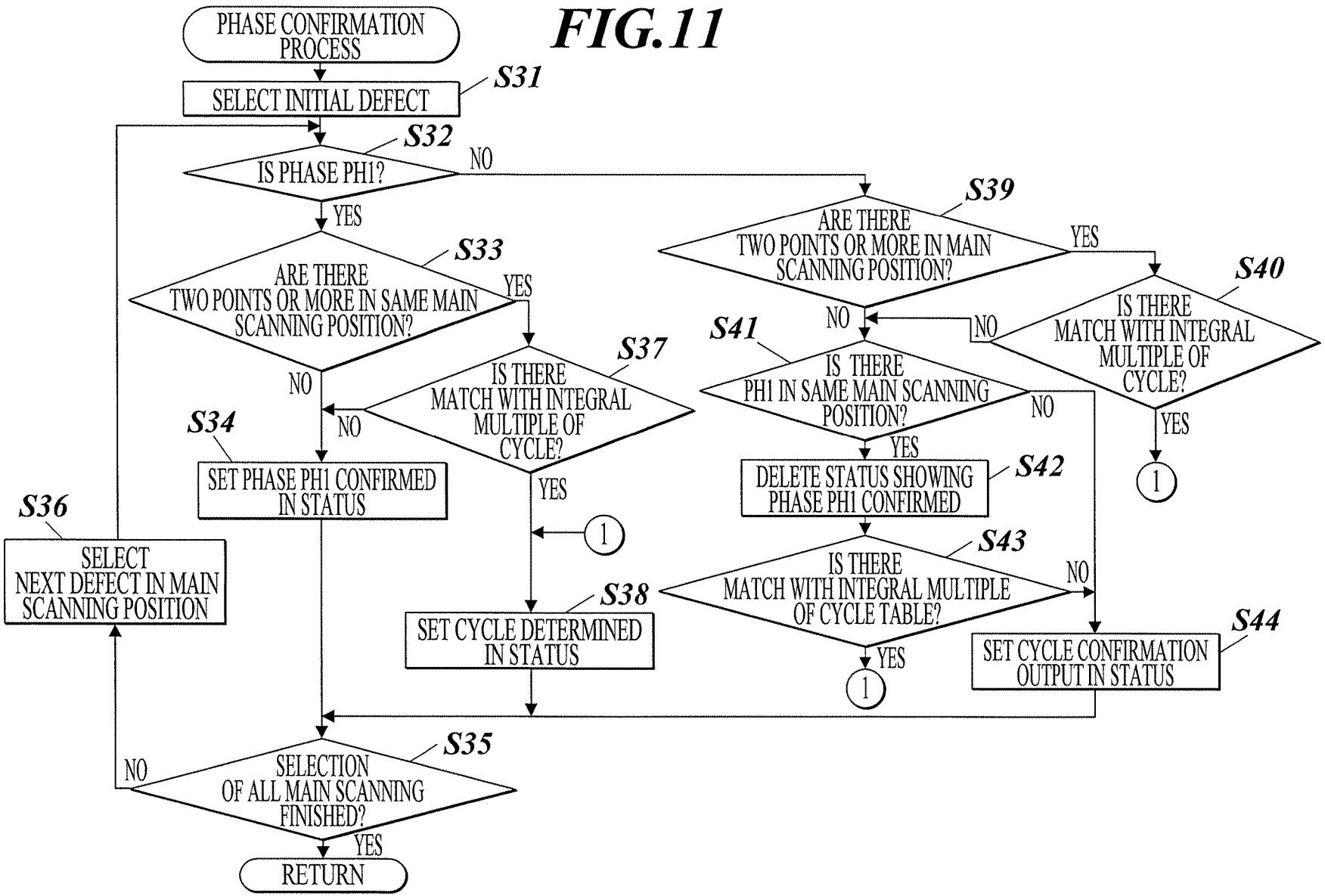
FIG. 11 is a flowchart showing a phase confirmation process.
Figure 12:
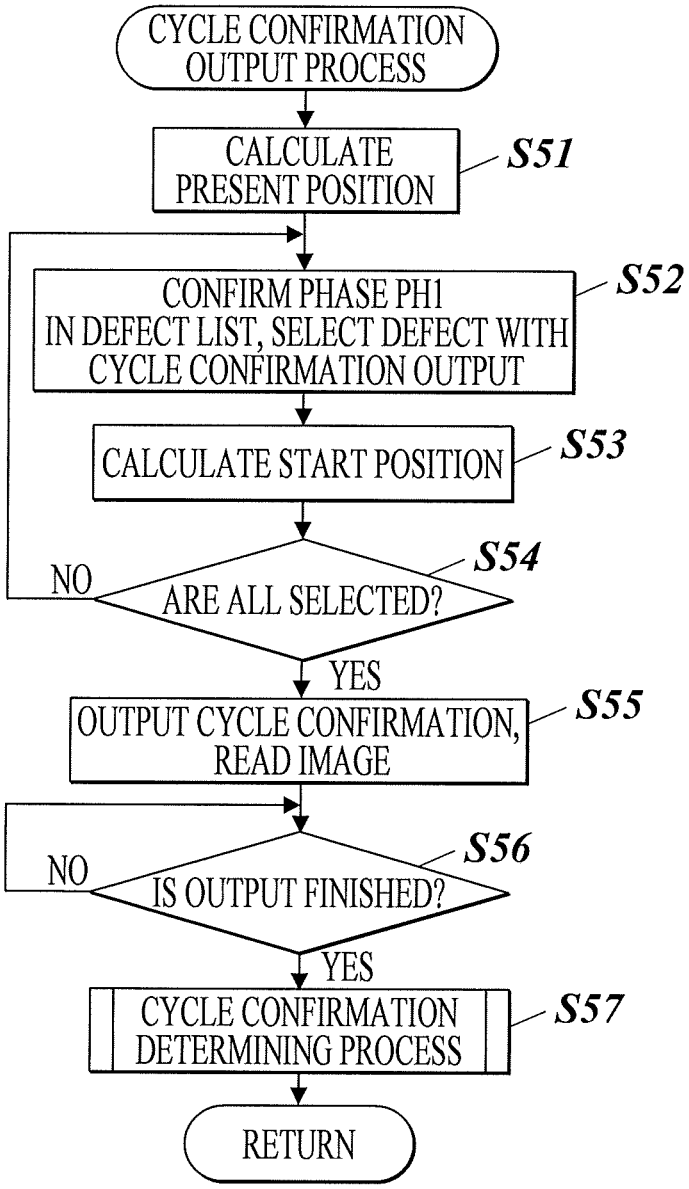
FIG. 12 is a flowchart showing a cycle confirmation output process.
Figures 13, 14:
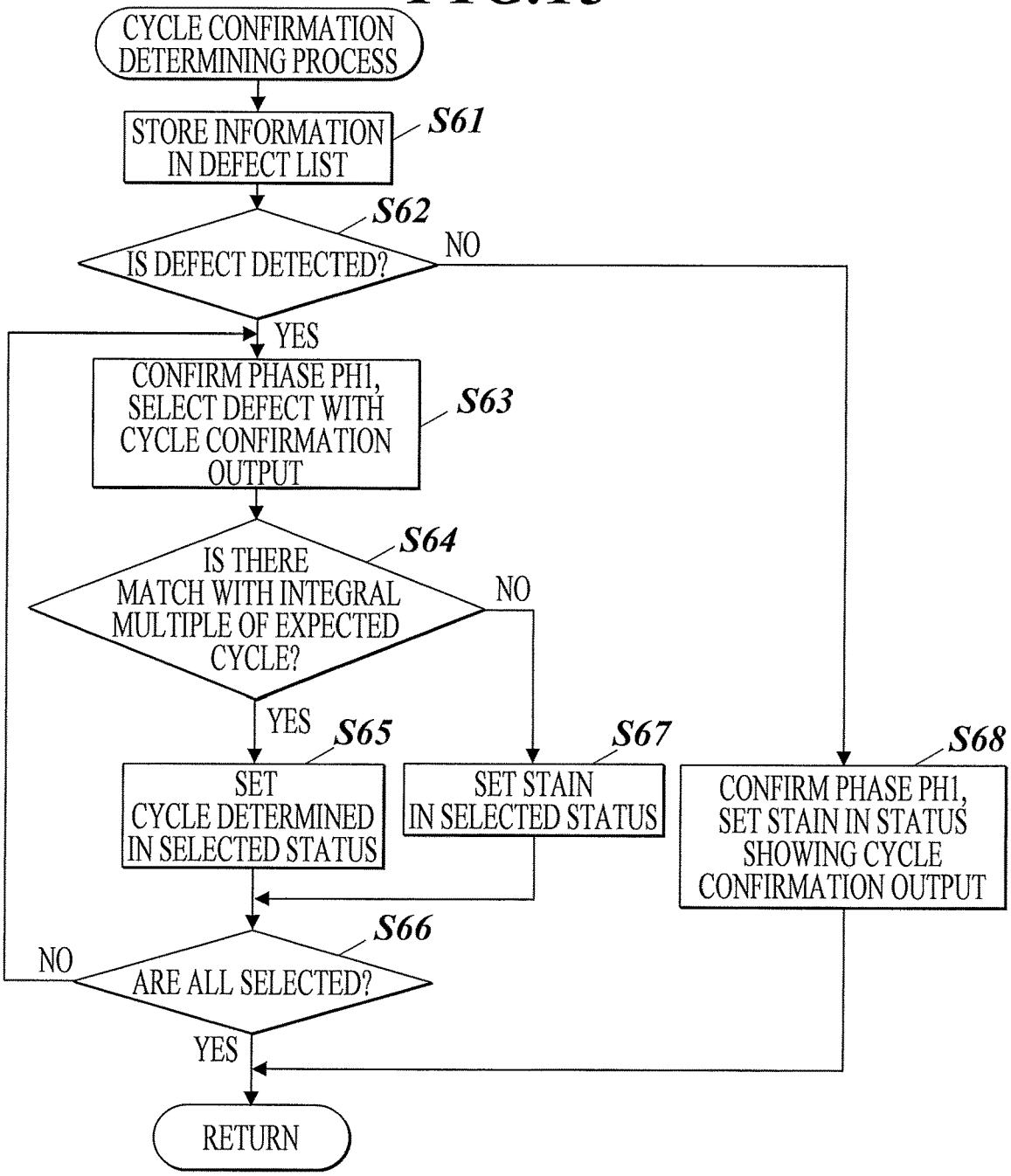
FIG. 13 is a flowchart showing a cycle confirmation determining process.
FIG. 14 is a diagram showing a defect list.
Figure 15:
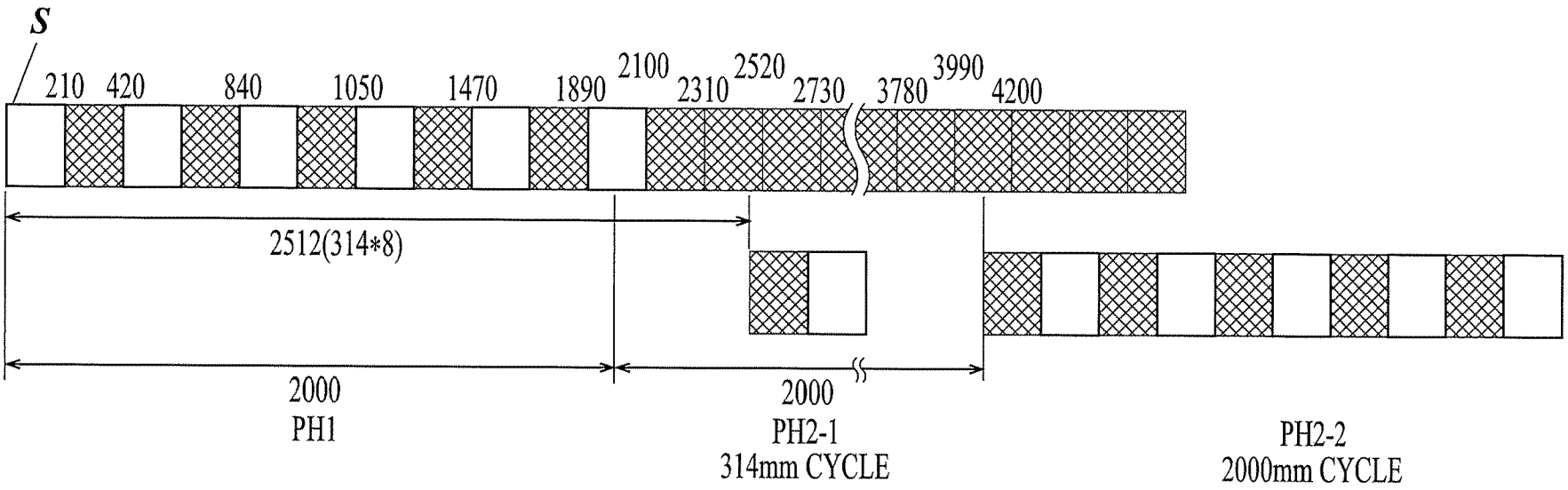
FIG. 15 is a diagram showing output of a sheet of first and second phases corresponding to components of a cycle table.

Next, with reference to FIG. 9 to FIG. 15, the specific process of the image forming apparatus 1 according to the present embodiment is described. FIG. 9 is a flowchart showing a failure diagnosis process. FIG. 10 is the flowchart showing a confirmation process. FIG. 11 is a flowchart showing a phase confirmation process. FIG. 12 is a flowchart showing a cycle confirmation output process. FIG. 13 is a flowchart showing a cycle confirmation determining process. FIG. 14 is a diagram showing a defect list L1. FIG. 15 is a diagram showing a sheet output in the phases PH1 and PH2 corresponding the parts in the cycle table T1.

The failure diagnosis process performed in the image forming apparatus 1 is described with reference to FIG. 9 to FIG. 15. According to the failure diagnosis process, the sheets are output as a dedicated mode to perform failure diagnosis by output of sheets dedicated to failure diagnosis (dedicated examination mode). Then, the image is read, the defect is confirmed, and the cycle is determined. With this, the failed part is specified.

The failure diagnosis process can be performed in the dedicated mode and the normal diagnosis mode (real-time examination mode) which performs the failure diagnosis in the output of the sheet of normal image contents. The normal diagnosis mode detects the defect by comparing the image read by the image reading apparatus 200 and the correct image. For example, one normal image is output on the sheet, the image is read by the image reading apparatus 200, and the output product is confirmed by human sight. If there is no abnormality, the read image data is considered to be the correct image. Alternatively, RIP (Raster Image Processor) image data can be the correct image (image data input to be used in the output of the image).

The correct image can be compared with the examination target image to find the periodic defect and to discover the defect in the part. In the dedicated mode, the image showing contents is not formed, and a test pattern with the background in a certain color (gray, white, etc.) is output. The periodic defect is detected by the tone of the read image not being a certain tone, and the failed part is diagnosed. In the normal diagnosis mode, since the images including the image showing contents are compared, the accuracy of detecting the defect decreases. In the dedicated mode, the defect can be detected with high accuracy, but excess amount of paper is necessary compared to the normal diagnosis mode.

In the failure diagnosis process, the image forming apparatus 1 performs only single sided printing in the dedicated mode of the failure diagnosis, and the image reader 202B of the image reading apparatus 200 performs reading of the image formed on the sheet For example, in the image forming apparatus 1, the user inputs the instruction to execute the test diagnosis process through the operation/display unit 20 and this acts as a trigger so that the image control CPU 11 performs the failure diagnosis process according to the failure diagnosis program stored in the nonvolatile memory 12. The timing that the above instruction is input is every morning before printing, when the amount of wasted paper discovered by the image reading apparatus 200 is large, or when the defect is assumed due to prediction of failure.

As shown in FIG. 9, first the image control CPU 11 obtains the sub-scanning width of the sheet for failure diagnosis according to selection of the sheet used in the failure diagnosis input by the user through the operation/display unit 20 (step S11). Then, the image control CPU 11 reads the cycle table T1 from the nonvolatile memory 12, and obtains the maximum cycle in which the cycle T12 is the largest (step S12).

Then, the image control CPU 11 uses the sub-scanning width and the maximum cycle obtained in steps S11 and S12 and sets the number of output sheets and the conveying interval (sheet interval) in phase PH1 (step S13). For example, in step S13, the sheet interval is set to the sub-scanning width of one sheet and the number of sheets output in the phase PH1 is set to a value corresponding to a value equal to or more than the maximum cycle including the sub-scanning width and the sheet interval.

Then, the image control CPU 11 extracts the cycle T12 of the part to be diagnosed among the cycles T12 in the cycle table T1 and as phase PH2, sets the starting point (start timing) of the output of the sheet corresponding to the cycle of the extracted parts and the number of sheets that are output (step S14). In step S14, for example, 2000 mm which is the cycle T12 for the intermediate transfer belt 421 of the part T11 and 314 mm which is the cycle T12 for the photoreceptor drum 413 of the part T11 are extracted as the targets in the phase PH2. 100 mm which is the cycle T12 for the developer 412 of the part T11 is smaller than the sub-scanning width of the sheet, and when there is a defect, at least two defects are formed in one sheet in phase PH1. Therefore, this is not extracted as the target of the phase PH2. As shown in FIG. 7, regarding the starting point of the sheet output corresponding to the cycle of the extracted part in the phase PH2 and the number of output sheets, the starting point is set in a position delaying the phase 180 degrees with reference to the phase ((top) position) of the sheet output in the phase PH1 and in a position corresponding to the integral multiplication of the cycle of the extracted part, and the number of output sheets is set to a value corresponding to a value equal to or more than the length of the cycle including the sub-scanning width and the sheet interval.

Then, based on the number of output sheets and sheet interval in the phase PH1 set in step S13 and the starting point and the number of output sheets in the phase PH2 set in step S14, the image control CPU 11 controls the sheet feeder 50, the image former 40, the fixer 60, and the sheet conveyor 70 to perform the sheet output together with the forming of the test patterns of the phases PH1 and PH2, and controls the image reading apparatus 200 to read the image on the output sheet in order to obtain the read image data (step S15).

Then, the image control CPU 11 determines whether the sheet output and the image reading in step S15 is finished (step S16). When the sheet output and the image reading are not finished (step S16; NO), the process advances to step S16. When the sheet output and the image reading are finished (step S16; YES), the image control CPU 11 performs the confirmation process (step S17).

Here, with reference to FIG. 10, the confirmation process of step S17 is described. First, as shown in FIG. 10, the image control CPU 11 initializes the defect list L1 (step S21). As shown in FIG. 14, the defect list L1 is a list storing the information for each defect detected from the image data of the read sheet. The defect list L1 includes items such as number L10, main scanning position L11, sub-scanning position L12, phase L13, status L14, and result L15. The number L10 shows an identification number of the defect. The main scanning position L11 is a position of the defect of the number L10 in the main scanning direction. The sub-scanning position L12 is the position of the defect of the number L10 in the sub-scanning direction. For example, the sub-scanning position L12 is the sub-scanning position from the top position in the phase PH1 in the sub-scanning direction. The phase L13 is the phase of the sheet in which the defect of the number L10 is detected. The phase L13 is phase PH1, phase PH2 or the phase for the sheet confirmation corresponding to the sheet confirmation output. When the phase L13 is the phase PH2, the information of the part corresponding to the cycle of the output sheet in the phase PH2 can be included.

The status L14 shows information showing the state of the defect of the number L10 and includes information such as "phase PH1 confirmed", "cycle confirmation output", "cycle determined", "output in process", and "stain". "Phase PH1 confirmed" shows a state in which one defect is detected in the same main scanning position in the phase PH1. "Cycle confirmation output" shows a state showing that one defect is detected in the same main scanning position in the phases PH1 and PH2 and it is before sheet output to confirm the cycle. "Cycle determined" shows a state showing that the cycle of the defect is determined. "Output in process" shows information showing that the sheet for confirming the cycle is being output. "Stain" shows a state in which it is assumed that since the defect is not a periodic defect, there is a stain due to a moving body such as garbage and there is no failure in the parts. The result L15 shows the failure diagnostic result of the number L10, and shows the determined cycle of the defect (determined cycle), the part corresponding to the determined cycle, the determined stain, and the like.

Then, the image control CPU 11 analyzes the image of the image data on the sheet obtained in step S15 to detect the defect, and determines whether at least one defect is detected (step S22). When the defect is not detected (step S22; NO), the confirmation process ends. When the defect is detected (step S22; YES), the image control CPU 11 stores in the defect list L1 the information regarding the defect for each detected defect, and sorts each record of the defect list L1 according to the phase PH1, the phase PH2 and the main scanning position (step S23). When the information is stored in the defect list L1 in step S23, for example, the main scanning position, the sub-scanning position, and the phase of the sheet regarding the defect obtained by the analysis of the image are stored in the main scanning position L11, the sub-scanning position L12, and the phase L13 of one record, and the number L10 is applied. When the phase L13 is the phase PH2, the information regarding the corresponding part can be included.

Then, the image control CPU 11 performs the phase confirmation process (step S24). Here, with reference to FIG. 11, the phase confirmation process in step S24 is described. First, as shown in FIG. 11, the image control CPU 11 selects a record of an initial (top) defect from among the defects in the sorted defect list L1 (step S31). Then, the image control CPU 11 determines whether phase L13 in the record of the selected defect is the phase PH1 (step S32).

When it is determined to be the phase PH1 (step S32; YES), the image control CPU 11 refers to the main scanning position L11 in the record of the defect list L1 in which the phase L13 is the phase PH1, and determines whether there are two or more records of the defect in the same main scanning position as the selected defect (step S33). When there is one record of the defect (step S33; NO), the image control CPU 11 sets "phase PH1 confirmed" in the status L14 in the record of the selected defect (step S34). Then, the image control CPU 11 determines whether the selecting of the records of the defects is finished in all main scanning in all phases (step S35).

When the selection of the defect for all main scanning is finished (step S35; YES), the phase confirmation process ends. When the selection of the defect for all main scanning is not finished (step S35; NO), the image control CPU 11 selects the record of the next defect in the main scanning position (if there is none, the next phase) from the defect list L1 (step S36) and advances the process to step S32. When the record of the defect is two or more (step S33; YES), the image control CPU 11 determines whether the length from the sub-scanning position L12 of the record of the selected defect to the sub-scanning position L12 of the next and after record of the defect in the same main scanning position L11 in the phase PH1 matches the integral multiple of the cycle T12 of any of the parts T11 in the cycle table T1 (step S37).

When there is no match to the integral multiple of the cycle T12 (step S37; NO), the process advances to step S34. When there is a match to the integral multiple of the cycle T12 (step S37; YES), the image control CPU 11 sets "cycle determined" in the status L14 in the record of the selected defect and sets the cycle T12 as the determined cycle with the match and the part corresponding to this cycle T12 in the result L15 (step S38). With this, the process advances to step S35.

When it is the phase PH2 (step S32; NO), the image control CPU 11 refers to the main scanning position L11 of the defect list L1 and determines whether the record of the defect is two or more in the same main scanning position as the selected defect in the phase PH2 (step S39). When the record of the defect is two or more (step S39; YES), the image control CPU 11 determines whether the length from the sub-scanning position L12 of the record of the selected defect to the sub-scanning position L of the next and after record of the defect with the same main scanning position L11 matches the integral multiple of any of the cycles T12 in the cycle table T1 (step S40). In step S40, when the information of the part corresponding to the phase PH2 is included in the phase L13 in the record of the selected defect, the image control CPU 11 may determine whether the length from the selected defect in the phase PH2 to the other defect with the matching main scanning position matches the integral multiple of the cycle T12 corresponding to the part included in the phase L13 in the record of the selected defect (part T11 in cycle table T1). When there is a match with the integral multiple of the cycle T12 (step S40; YES), the process advances to step S38.

When the record of the defect is one (step S39; NO), or there is no match with the integral multiple of the cycle T12 (step S40; NO), the image control CPU 11 refers to the main scanning position L11 of the defect list L1 and determines whether there is a record with the phase PH1 with the same main scanning position L11 as the record of the selected defect (step S41). When there is the record of the phase PH1 with the same main scanning position (step S41; YES), the image control CPU 11 deletes the status contents when "phase PH1 confirmed" is described in the status L14 in the record of the phase PH1 with the same main scanning position (step S42).

Then, the image control CPU 11 determines whether the length from the sub-scanning position L12 of the record of the defect with the same main scanning position L11 in the phase PH1 determined in step S41 to the sub-scanning position L12 of the record of the defect in the selected phase PH2 matches with the integral multiple of any of the cycle T12 in the cycle table T1 (step S43). In step S43, when the information of the part corresponding to the phase PH2 is included in the phase L13 of the record in the selected defect, the image control CPU 11 may determine whether the length from the defect in the phase PH1 to the selected defect matches the integral multiple of the cycle T12 corresponding to the part included in the phase L13 in the record of the selected defect (part T11 of cycle table T1).

When there is a match with the integral multiple of the cycle T12 (step S43; YES), the process advances to step S38. When there is no record of the phase PH1 with the same main scanning position (step S41; NO) or there is no match with the integral multiple of the cycle T12 (step S43; NO), the image control CPU 11 sets "cycle confirmation output" in the status L14 in the record of the selected defect (step S44). With this, the process advances to step S35.

Returning to FIG. 10, after the phase confirmation process in step S24 is performed, the image control CPU 11 refers to the status L14 of the defect list L1 and determines whether there is a record with "phase PH1 confirmed" or "cycle confirmation output" (step S25). When there is no record with "phase PH1 confirmed" or "cycle confirmation output" (step S25; NO), the confirmation process ends. When there is a record with "phase PH1 confirmed" or "cycle confirmation output" (step S25; YES), the image control CPU 11 performs the cycle confirmation output process (step S26).

Here, with reference to FIG. 12, the cycle confirmation output process in step S26 is described. As shown in FIG. 12, first, the image control CPU 11 calculates the present position in forming the image from the phase PH1 in the sub-scanning direction (step S51). Then, the image control CPU 11 selects the next one record with the defect in which the status L14 shows "phase PH1 confirmed" or "cycle confirmation output" from the defect list L1 (step S52).

Then, the image control CPU 11 calculates the starting point of the cycle confirmation which is equal to or after the present position in step S51 and in which the length from the sub-scanning position L12 to the starting point of the sheet output for cycle confirmation is to be the integral multiple of the expected cycle (cycle T12) corresponding to the part L14 (part T11 in cycle table T1) from the sub-scanning position L12, the phase L13, and the part L14 in the record of the selected defect (step S53). In step S53, the distance from the corresponding part to the image reading apparatus 200 (image reader 202) is considered and the starting point is set in a position where there is a sufficient possibility that the sheet output for cycle confirmation can be performed.

In step S53, the image control CPU 11 considers the distance from the part to the image reading apparatus 200 and sets the start position of the sheet output for cycle confirmation output. There can be an interval in the position of the cycle confirmation output after the phases PH1 and PH2 as long as it is an integral multiple of the cycle, and the test pattern is formed in a slightly separated position after the image is read with the image reading apparatus 200.

Then, the image control CPU 11 determines whether all of the records with "phase PH 1 confirmed" or "cycle confirmation output" are selected from the defect list L1 (step S54). When the cycle confirmation output is not finished (step S54; NO), the process advances to step S52. When the cycle confirmation output is finished (step S54; YES), the image control CPU 11 controls the sheet feeder 50, the image former 40, the fixer 60, and the sheet conveyor 70 to output one sheet for each cycle confirmation at the starting point of each cycle confirmation set in step S53. Then, the image control CPU 11 controls the image reading apparatus 200 to allow the image reading apparatus to read the image on the output sheet, and the image control CPU 11 obtains the read image data (step S55).

Then, the image control CPU 11 determines whether the sheet output and the image reading in step S55 is finished (step S56). When the sheet output and the image reading is not finished (step S56; NO), the process advances to step S56. When the sheet output and the image reading is finished (step S56; YES), the image control CPU 11 performs the cycle confirmation determining process (step S57).

Here, with reference to FIG. 13, the cycle confirmation determining process in step S57 is described. As shown in FIG. 13, first, the image control CPU 11 analyzes the image data on the sheet obtained in step S54 to detect the defect in cycle confirmation, and stores the information regarding the defect in the defect list L1 (step S61). When the information regarding the defect is stored in the defect list L1 in step S61, for example, the main scanning position and the sub-scanning position of the defect obtained in the image analysis and the "cycle confirmation" corresponding to the output sheet is stored in the main scanning position L11, sub-scanning position L12, and the phase L13 of one record, and the number L10 is applied. Then, the image control CPU 11 determines whether at least one defect is detected (step S62). When the defect is detected (step S62; YES), the image control CPU 11 selects one record of the next defect in which the status L14 is "phase PH1 confirmed" or "cycle confirmation output" from the defect list L1 (step S63).

Then, the image control CPU 11 calculates the length from the sub-scanning position L12 in the record of the selected defect to the sub-scanning position L12 in the record in which the main scanning position L11 is the same and the phase L13 is "sheet confirmation". The image control CPU 11 determines whether the calculated length matches with the integral multiple of the expected cycle which is the cycle T12 other than the determined cycle (cycle T12 determined in the cycle table T1) of the result L15 in the record in which the status L14 is "cycle determined" in the defect list L1 (step S64). When there is a match with the integral multiple of the expected cycle (step S64; YES), the image control CPU 11 sets "cycle determined" in the status L14 in the record of the selected defect, and sets the expected cycle as the matching determined cycle and the part corresponding to the expected cycle in the result L15 (step S65).

Then, the image control CPU 11 determines whether all of the records of the defect with "phase PH1 confirmed" or "cycle confirmation output" are selected in step S63 (step S66). When all of the records of the defect with the "phase PH1 confirmed" or "cycle confirmation output" are not selected (step S66; NO), the process advances to step S63. When all of the records of the defect with the "phase PH1 confirmed" or "cycle confirmation output" are selected (step S66; YES), the cycle confirmation determining process ends.

When there is no record with the integral multiple of the expected cycle (step S64; NO), the image control CPU 11 sets "stain" in the status L14 in the record of the selected defect (step S67) and advances the process to step S66. When the defect is not detected (step S62; NO), the image control CPU 11 sets "stain" in the status L14 in all of the records with "phase PH1 confirmed" or "cycle confirmation output" in the status L14 in the defect list L1 (step S68). With this, the cycle confirmation determining process ends.

Returning to FIG. 9, after the confirmation process in step S17 is performed, the image control CPU 11 refers to the defect list L1, and displays on the operation/display unit 20 the failure diagnosis result including the result L15 (determined cycle, part) of the record with "cycle determined" in the status L14 and the result L15 (stain) of the record with "stain" in the status L14 (step S18). With this, the failure diagnostic process ends. The user or repairman of the image forming apparatus 1 confirms the failure diagnosis result by sight, and exchanges or repairs the part in which the periodic defect occurred.

In the failure diagnosis process, for example, as shown in FIG. 15, output of the sheet S in the phase PH1, output of the sheet S in the phase PH2 (phase PH2-1) in which the part is the photoreceptor drum 413, and output of the sheet S in the phase PH2 (phase PH2-2) in which the part is the intermediate transfer belt 421 is performed. Here, the sheet S is size A4 and the sheet output for cycle confirmation is not considered.

In the phase PH2-1, one sheet S is output because, in the position shifting the phase 180 degrees from the top position in the phase PH1 considering the sheet S not shifted 180 degrees in the phase PH1, the part is the photoreceptor drum 413 and the cycle is 314 mm, and 314 mm<sub-scanning width of sheet S (210 mm)×2. In the phase PH2-2, five sheets S are output because, in the position shifting the phase 180 degrees from the top position in the phase PH1 considering the sheet S not shifted 180 degrees in the phase PH1, the part is the intermediate transfer belt 421 and the cycle is 2000 mm, and 2000 mm<sub-scanning width of sheet S (210 mm)×10. Therefore, according to the example shown in FIG. 15, the failure diagnosis in phases PH1 and PH2 can be performed with the output of a total of 12 sheets S.

According to the present embodiment, the image forming apparatus 1 includes a plurality of parts including the rotating unit and forms the image on the sheet using the plurality of parts. The image forming apparatus 1 includes a sheet feeder 50 and a sheet conveyor 70 which convey the sheets, an image former 40 and a fixer 60 which form an image on the conveyed sheets and an image reading apparatus 200 which reads the image data of the sheet on which the image is formed. The image forming apparatus 1 also includes an image control CPU 11 which controls the sheet conveying interval conveyed by the sheet feeder 50 and the sheet conveyor 70, which controls the image former 40 and the fixer 60 to form the image on the sheet and output the sheet, which detects the defect from the read image data, and which performs diagnosis of the failed part in which the defect is detected periodically based on the information of the detected defect and the cycle of the part. When the failed part is diagnosed, the image control CPU 11 controls the image former 40 and the fixer 60 to form an image for failure diagnoses, and sets the conveying interval of the sheet conveyed by the sheet feeder 50 and the sheet conveyor 70 to a conveying interval larger than when the image is normally formed.

According to the above, the sheet is output with the sheet conveying interval enlarged to supplement the sheet interval and the defect is defected. Therefore, the number of sheets used in the failure diagnosis can be reduced.

As the sheet confirmation output, the image control CPU 11 outputs the sheet in the position at the integral multiple of the cycle of the part from the detected first defect. The image control CPU 11 specifies the cycle of the second defect detected in the position at the integral multiple of the cycle of the part from the first defect. Therefore, when the first defect is detected, the cycle confirmation output is performed so that the cycle of the second defect can be specified. Consequently, the failure diagnosis can be performed accurately.

The image control CPU 11 sets the position of the sheet output in the position at the integral multiple of the cycle of the part in which the cycle is confirmed according to the distance from the part to the image reading apparatus 200. Therefore, there is sufficient time from when the image is formed to when the image is read. Consequently, for example, after the output position of the sheet in the cycle confirmation output is determined, the sheet can be output surely in this output position.

The image control CPU 11 outputs a plurality of sheets in the length equal to or later than the maximum cycle of the part as the first phase and outputs the sheet with the phase shifted from the first phase at the position and length corresponding to the cycle of the part as the second phase. The sheet output in the second phase which supplements the sheet conveying interval of the first phase is performed corresponding to each part. Therefore, the sheet used in failure diagnosis can be reduced even more.

The image control CPU 11 sets the sheet conveying interval to the sub-scanning width of the sheet, and outputs the sheet with the phase shifted 180 degrees from the first phase in the second phase. Therefore, the number of sheets used in the failure diagnosis can be suppressed to a minimum number.

Among the detected defect, when the cycle cannot be specified for the defect, the image control CPU 11 specifies "stain" as the defect caused by moving particles such as garbage. Therefore, the defect caused by the part can be specified more accurately.

The description in the above-described embodiments are merely an example of the image forming apparatus and recording medium suitable for the present invention, and the present invention is not limited to the above.

For example, according to the present embodiment, the image forming apparatus 1 forms the color image using toners consisting of four colors YMCK, but the present invention is not limited to the above. For example, the image forming apparatus 1 can form a monochrome image using black toner.

According to the present embodiment, there is no record with the same cycle T12 in the cycle table T1, but the present invention is not limited to the above. When there are the plurality of records for the parts T11 with the same cycle T12 in the cycle table T1, after the failure diagnosis process is performed, the image control CPU 11 can shift the phase of the rotating part of one of parts among the plurality of records for the parts T11 and the defect can be detected by cycle confirmation output. When the phase of the sub-scanning position in the detected defect is shifted, the image control CPU 11 determines there is a failure in the part with the shifted phase, and when the phase is not shifted, the image control CPU 11 determines there is a failure in another part in which the phase is not shifted. This is displayed included in the failure diagnosis result. In order to correct the density unevenness in the sub-scanning direction in the image forming apparatus 1, for example, when a phase detecting sensor is provided in the photoreceptor drum 413, the developer 412, and the intermediate transfer belt 421, the phase is shifted using such phase detecting sensor and it is determined whether the position of the defect is shifted. According to such configuration, it is possible to accurately specify the part in which the defect of the cycle actually occurred among the plurality of parts including the same cycle.

According to the present embodiment, the cycle confirmation output is performed for all records of the defect with "phase PH1 confirmed" or "cycle confirmation output" in the status L14 of the defect list L1, but the present invention is not limited to the above. The image control CPU 11 may be configured so as not to perform the cycle confirmation output corresponding to the detected defect when only one defect is detected after the sheet output in the phases PH1 and PH2 (for example, status L14 corresponds to "phase PH1 confirmed" or "cycle confirmation output"). When the garbage which moves as the moving body is attached to the part, the defect of small garbage usually appears as the streak. When the garbage is large, a scar appears, but this occurs in a random main scanning position and random cycle while the maximum cycle is being confirmed. Therefore, when there is a defect which appears only once in the maximum cycle in the phase PH1, there is a high possibility of cycle failure, and the image control CPU 11 specifies that it is the defect in the maximum cycle. According to such configuration, the cycle confirmation output of the part with the maximum cycle is not performed, therefore, the sheet used for failure diagnosis can be reduced. Further, when a plurality of defects with different main scanning positions (phase is also different) occur once each in the maximum cycle, it can be assumed that the cause is garbage.

According to the failure diagnosis process of the present embodiment, the image forming apparatus 1 performs only single sided printing, and the image reader 202B of the image reading apparatus 200 reads the image on the sheet on which the image is formed, but the present invention is not limited to the above. In the failure diagnosis process, the image forming apparatus 1 can perform double-sided printing, and the image readers 202A and 202B of the image reading apparatus 200 can read the image on the sheet on which the image is formed. According to such configuration, the process becomes complicated, but both sides of the sheet are used to form the image for detection of the defect. Therefore, the number of sheets used for failure diagnosis can be decreased even more.

According to the failure diagnosis process of the present embodiment, the image forming apparatus 1 performs the failure diagnosis for all parts T11 set in the cycle table T1, but the present invention is not limited to the above. In the failure diagnosis process, setting information of whether to perform failure diagnosis for the parts T11 with the cycle T12 with long maximum cycles among all of the parts T11 set in the cycle table T1 may be received from the user through the operation/display unit 20. According to the setting information, the image control CPU 11 may perform failure diagnosis for the part T11 other than the part T11 of the maximum cycle T12 among all of the parts T11 set in the cycle table T1. The frequency that the defect occurs in the part with the long cycle is low, and the number of times that the failure diagnosis is performed can be reduced. According to such configuration, the burden of performing the failure diagnosis for the part with the long cycle can be reduced according to the operation by the user, and the sheet used for the failure diagnosis can be reduced.

According to the present embodiment, the image forming apparatus 1 performs the failure diagnosis process in a dedicated mode, but the present invention is not limited to the above. For example, in the image forming apparatus 1, the image control CPU 11 can perform the failure diagnosis process which outputs a sheet with the image formed on the back side of the sheet used for a different examination such as a tone test for parts in which two cycles is shorter than the sub-scanning width of the sheet. According to such configuration, the sheet for the failure diagnosis can be reduced.

When the user or the repairman exchanges the part of the image forming apparatus 1, the image control CPU 11 may perform the failure diagnosis process regarding the cycle T12 of the part T11 after exchange among all of the parts T11 set in the cycle table T1. According to such configuration, the failure of the exchanged part can be diagnosed immediately.

The detailed configuration and the detailed operation of the image forming apparatus 1 according to the present embodiment can be suitably changed without leaving the scope of the present invention.

Although embodiments of the present invention have been described and illustrated in detail, the disclosed embodiments are made for purposes of illustration and example only and not limitation. The scope of the present invention should be interpreted by terms of the appended claims.

The entire disclosure of Japanese Patent Application No. 2018-016858 filed on Feb. 2, 2018 is incorporated herein by reference in its entirety.

What is claimed is:

1. An image forming apparatus which includes a plurality of parts including a rotating unit and which uses the plurality of parts to form an image on a sheet, the apparatus comprising:

a sheet conveyor which conveys a plurality of sheets;

an image former which forms an image on the conveyed sheet;

an image reader which reads image data on a sheet on which the image is formed; and a hardware processor which controls a conveying interval of the sheet by the sheet conveyor, which controls the image former to form an image on the sheet and to output the sheet, which detects a defect from the read image data, and which diagnoses a failed part in which the defect is detected periodically based on information of the detected defect and a cycle of the part, wherein when the failed part is diagnosed, the hardware processor controls the image former to form an image for failure diagnosis and sets a conveying interval of the sheet by the sheet conveyor larger than the conveying interval in normal image forming.

2. The image forming apparatus according to claim 1, wherein the hardware processor outputs the sheet in a position at an integral multiple of the cycle of the part from a detected first defect and specifies the cycle of a second defect detected in a position at an integral multiple of the cycle of the part from the first defect.

3. The image forming apparatus according to claim 2, wherein the hardware processor sets a position where the sheet is output at the position at the integral multiple of the cycle of the part according to a distance from the part to the image reader.

4. The image forming apparatus according to claim 1, wherein the hardware processor outputs a plurality of sheets at a length equal to or larger than a maximum cycle of the part as a first phase and outputs the sheet at a phase shifted from the first phase in a position and a length corresponding to the cycle of the part as a second phase.

5. The image forming apparatus according to claim 4, wherein the hardware processor sets the conveying interval of the sheet to a sub-scanning width of the sheet and in the second phase, the hardware processor outputs the sheet shifting the phase 180 degrees from the first phase.

6. The image forming apparatus according to claim 1, wherein, when there are a plurality of parts with the same cycle, the hardware processor outputs the sheet with the phase of one part among the plurality of parts shifted; and the hardware processor specifies the part with the phase shifted based on the information of the detected defect.

7. The image forming apparatus according to claim 1, wherein the hardware processor specifies a defect in which the cycle cannot be specified from the detected defect as a defect by a moving body.

8. The image forming apparatus according to claim 1, wherein, the image former is able to form an image on both sides of the sheet;

the hardware processor forms the image on both sides of the sheet and outputs the sheet; and the image reader reads the image data of the sheet on which the image is formed on both sides of the sheet.

9. The image forming apparatus according to claim 1, wherein the hardware processor outputs the sheet for the cycle of the part other than the part with a long cycle according to operation input information to omit the failure diagnosis of the part with the long cycle.

10. The image forming apparatus according to claim 1, wherein the hardware processor outputs the sheet to form the image on a back side of the sheet used in a different examination for the cycle of the part in which two cycles is shorter than the sub-scanning width of the sheet.

11. The image forming apparatus according to claim 1, wherein the hardware processor outputs the sheet according to the cycle of the exchanged part.

12. A non-transitory computer-readable recording medium having a program stored thereon for controlling a computer used in an image forming apparatus which includes a plurality of parts including a rotating unit and which uses the plurality of parts to form an image on a sheet, wherein the program controls the computer to function as:

a sheet conveyor which conveys a plurality of sheets;

an image former which forms an image on the conveyed sheet;

an image reader which reads image data on a sheet on which the image is formed; and a hardware processor which controls a conveying interval of the sheet by the sheet conveyor, which controls the image former to form an image on the sheet and to output the sheet, which detects a defect from the read image data, and which diagnoses a failed part in which the defect is detected periodically based on information of the detected defect and a cycle of the part, wherein when the failed part is diagnosed, the hardware processor controls the image former to form an image for failure diagnosis and sets a conveying interval of the sheet by the sheet conveyor larger than the conveying interval in normal image forming.

* * * * *